US005358389A

United States Patent [19]

Haegermarck

[11] Patent Number: 5,358,389

[45] Date of Patent: Oct. 25, 1994

[54] TWO-STAGE COMPRESSION VACUUM PUMP HAVING VALVED PISTON AND POWER LIMITING VALVE

[75] Inventor: Anders Haegermarck, Trångsund, Sweden

[73] Assignee: Electrolux Research & Innovation Aktiebolag, Sweden

[21] Appl. No.: 115,479

[22] Filed: Sep. 1, 1993

[30] Foreign Application Priority Data

Sep. 10, 1992 [SE] Sweden ..... 9202608

[51] Int. Cl.[5] ..... F04B 39/10

[52] U.S. Cl. ..... 417/260; 417/284; 417/289; 417/433; 417/490; 417/513

[58] Field of Search ..... 417/259, 260, 284, 289, 417/432, 433, 513, 514, 516, 517, 523, 524, 552, 554, 490; 92/181, 181 P, 208

[56] References Cited

U.S. PATENT DOCUMENTS

| | | | |
|---|---|---|---|
| 854,954 | 5/1907 | Kohl | 417/433 |
| 873,528 | 12/1907 | Fleuss | 417/433 |
| 1,013,678 | 1/1912 | Morehouse | 92/181 R |
| 1,050,767 | 1/1913 | Fleuss | 417/433 |
| 2,926,644 | 3/1960 | Flamm | 92/208 |
| 3,594,103 | 7/1971 | Hillis | 417/554 |
| 3,884,597 | 5/1975 | Ito | 417/248 |
| 5,188,519 | 2/1993 | Spuligis | 417/513 |

FOREIGN PATENT DOCUMENTS

| | | | |
|---|---|---|---|
| 272302 | 12/1913 | Fed. Rep. of Germany | 417/433 |
| 457064 | 12/1913 | France | 417/433 |
| 8408 | of 1900 | United Kingdom | 417/552 |
| 12186 | 11/1911 | United Kingdom | 417/433 |
| 374682 | 12/1932 | United Kingdom | 417/433 |
| 510088 | 7/1939 | United Kingdom | 417/260 |

*Primary Examiner*—Richard E. Gluck
*Assistant Examiner*—Roland G. McAndrews, Jr.
*Attorney, Agent, or Firm*—Pearne, Gordon, McCoy & Granger

[57] ABSTRACT

This invention relates to a vacuum pump. The pump includes a pump housing (10) having upper and lower cylindrical, partly liquid filled, compression chambers (11 and 12 respectively) which are separated from each other and in which an upper and a lower part (14, 15) of a piston (12) is movable. The piston has a passage (21) which is provided with a check valve and which provides communication between the upper and the lower chamber (11 and 12 respectively). The upper chamber communicates, via an opening (26) which is provided with a check valve, with a liquid filled de-aeration receptacle (27). The lower chamber (12), during a part of the movement of the piston, via an inlet (33), communicates with the space being evacuated.

14 Claims, 1 Drawing Sheet

TWO-STAGE COMPRESSION VACUUM PUMP HAVING VALVED PISTON AND POWER LIMITING VALVE

BACKGROUND OF THE INVENTION

1. Field of the Invention

This invention relates to a vacuum pump. The pump according to the invention is primarily used to create a vacuum insulation for walls and doors of refrigerators and freezers.

2. Description of the Related Art

Previously suggested vacuum insulations for this purpose—see for instance SE 90937, EP 188806, U.S. Pat. No. 4,668,555—comprise powder or cellular materials which are placed in a diffusion-tight receptacle which is evacuated and sealed before it is placed in the wall or door panel of the refrigerator or freezer. It is, however, time consuming to continue with the evacuation procedure as long as is desirable, which means that the procedure is not particularly well suited for mass production. There is also a risk that leakage occurs in the diffusion-tight layer during the lifetime of the refrigerator, which is about 15 to 20 years, which means that the contribution which the vacuum gives to the insulating capability disappears.

In order to create a vacuum for this type of equipment, conventional vacuum pumps are used. For instance DE 157471 describes a one step evacuation pump having a piston reciprocating in a cylinder, the cylinder and piston being provided with a check valve system by means of which the air is evacuated through an oil reservoir to the atmosphere, whereas the oil is partly returned to the lower part of the pump where it is used to eliminate dead space. However, this type of vacuum pump is expensive, large, comparatively power demanding and cannot be used to evacuate water vapor or to continue the evacuation procedure to a particularly great extent.

SUMMARY OF THE INVENTION

The purpose of this invention is to achieve a two step vacuum pump which is to be installed permanently in a refrigerator or a freezer cabinet in order to create a vacuum in walls and a door of the cabinet when the cabinet is started up. Such an application is shown and described in co-pending U.S. patent application Ser. No. 08/115,213 and U.S. Ser. No. 08/115,895 filed on the same day as this invention. Since the pump has a low energy consumption, is inexpensive to produce, can pump water vapor and establishes a high degree of evacuation when being connected for a long period, the pump is very well suited for this purpose. The advantages mentioned above are achieved because the invention has the characteristics mentioned below and in the claims.

BRIEF DESCRIPTION OF THE DRAWINGS

An embodiment of the invention will now be described with reference to the accompanying drawing in which FIGS. 1 and 2 each show a vertical section through a pump according to the invention under different operating conditions.

DETAILED DESCRIPTION OF THE PREFERRED EMBODIMENT

Figure 2:
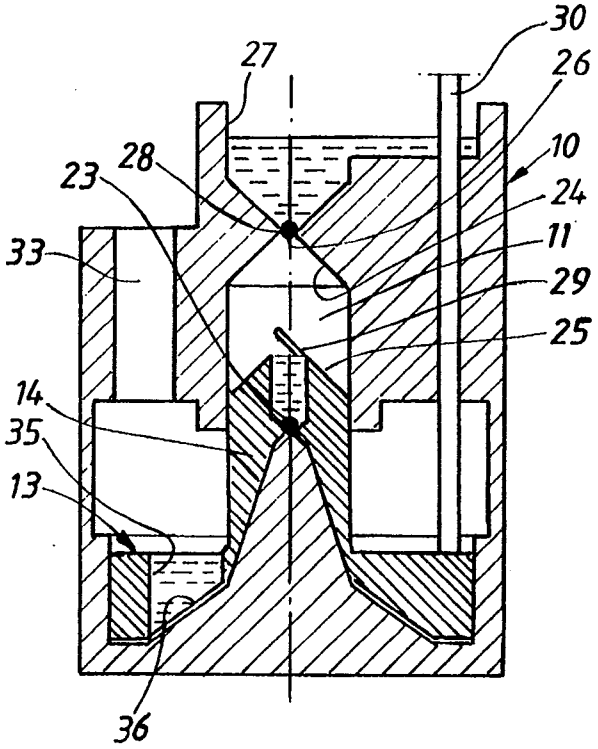

In the figures, a pump housing 10 has an upper and a lower cylindrical compression chamber 11 and 12, respectively. Between the two chambers, there is a piston 13 having an upper part 14 and a lower part 15. During upwards and downwards movements of the piston, each part 14, 15 slides in one of the chambers, the lower part having a larger diameter than the upper part. A bottom area 16 of the lower chamber has a mainly conical shape with three step-shaped portions 17, 18, 19 being parts of cones with different top angles. The piston 13 has a recess 20 with corresponding conical shapes which, in its upper part via an opening 21, enters into a central, vertical channel 22. The vertical channel 22 provides communication between the two chambers 11, 12. The lower part of the channel 22 is shaped as a valve seat in which a valve body 23, such as a ball, rests. A tip of the portion 19 has such a shape that, when the piston 13 is in its lower position, the tip lifts the valve body 23 from its seat.

Also, the top area 24 of the upper chamber 11 as well as an uppermost part 25 of the piston 13 have a mainly conical shape. The upper chamber 11, via an opening 26, communicates with a de-aeration receptacle 27 containing a liquid, preferably oil. The lower part of the de-aeration receptacle is shaped as a valve seat in which a valve body 28, such as a ball, normally rests. The valve body 28 is, in the uppermost position of the piston, lifted by means of a lifting element 29 which is arranged at the upper part 14 of the piston 13. This lifting element 29 also keeps the valve body 23 in its position in the channel 22.

The lower part 15 of the piston 13 is connected to driving means shaped as rods 30, of which one is shown in the figures. The rods extend through the pump housing 10 and the de-aeration receptacle 27. Up and down movement of the rods is achieved by means of a transmission mechanism 31, which is not shown in detail in the figures, and an electric drive motor 32, for instance a synchronous motor.

The pump housing also has an inlet 33 which communicates with the space being evacuated and this inlet also communicates with the chamber 12 via a passage 34 when the piston 12 is close to an upper dead point.

The lower part 15 of the piston 12 has an opening 35 which extends from its bottom side to its upper side, the lower part of which is provided with a mesh net 36 covering the opening and preferably having a mesh size of 10–50 $\mu$m and which is covered by oil. This arrangement, because of the surface tension of the oil, operates as a power restricting valve decreasing the top load on the drive motor 32 during the downwards movement of the piston 13 and admits gas to flow upwardly through the mesh net 36 under a suitable flow resistance but restricts the flow of oil in the same direction because of a considerably higher flow resistance.

Figure 1:
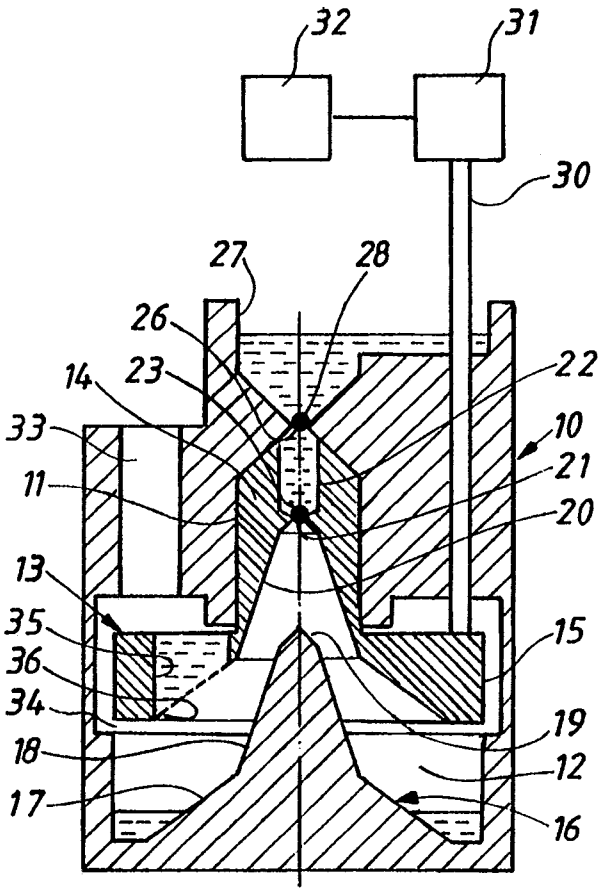

The pump operates in the following way. In FIG. 1 the piston 13 is shown at its upper dead point which means that the passage 34 connecting the inlet 33 with the chamber 12 is open. Shortly after the piston 13 has started its downward movement by means of the motor 32, the transmission mechanism 31, and the rods 30, the passage 34 is closed by means of the piston 13 and the compression of the gas which is present in the chamber 12 starts. The space below the piston is thus reduced and the oil which is present on the bottom of the chamber is, together with the gas which is present above the oil, pressed up towards the opening 21. When the pressure in the chamber 12 exceeds the pressure in the chamber 11 or when the tip of the portion 19 lifts the valve body 23 from the seat, see FIG. 2, gas and oil are pressed upwardly into the channel 22. Under certain conditions, gas and part of the oil also flow through the fine mesh net 36 and up through the oil layer above thereby limiting the power consumption of the pump.

When the piston 13, from the position shown in FIG. 2, moves upwards, a minor quantity of oil will flow back to the chamber 12, after which the valve body 23 returns back to the seat and prevents the oil from flowing back to the chamber 12 while the gas which is present above the oil in the chamber 11 is compressed. When the pressure in the chamber 11 is sufficiently large or when the element 29 reaches the valve body 28, the valve body moves away from the seat which means that the gas and possibly a part of the oil flow to the de-aeration receptacle 27 from which the gas then flows to the atmosphere. Simultaneously, gas again flows through the passage 34 to the chamber 12, after which the procedure mentioned above is repeated.

It should be observed that the pump demands very little mechanical power which means less than 1 W and preferably less than 0.1 W. The pump, therefore, is well suited to be used in a refrigerator or a freezer in order to evacuate wall panels, including doors, for a long period, which in this context means more than one week. The evacuation procedure thus goes very far and a pressure is created which is less than 1 mbar, preferably less than 0.1 mbar. The suggested design of the pump also makes it possible to pump water vapor, which usually is a problem for vacuum pumps.

It is also possible to return the oil from the de-aeration receptacle 27 to the lower chamber 12 by using a larger gap between the rods 30 and the housing 10. The mesh net 36 in the power limiting valve can also be replaced by other similar arrangements for instance by several through holes with such a small diameter that the capillary forces and the surface tension of the oil gives the intended effect.

Although the preferred embodiments of this invention have been shown and described, it should be understood that various modifications and rearrangements of the parts may be resorted to without departing from the scope of the invention as disclosed and claimed herein.

What is claimed is:

1. Vacuum pump comprising a pump housing (10) having upper and lower cylindrical, partly liquid filled, compression chambers (11 and 12 respectively) which are separated from each other and in which upper and lower parts (14, 15) of a piston (13) are movable, the piston having a passage (21) which is provided with a first check valve and which provides communication between the upper and lower chambers (11 and 12 respectively), the upper chamber, via an opening (26) which is provided with a second check valve, communicating with a liquid filled de-aeration receptacle (27), and the lower chamber (12), via an inlet (33), communicating with a space being evacuated during a portion of a piston cycle, wherein said upper part of said piston closes said upper chamber to prevent direct communication between said upper chamber and said space being evacuated throughout said piston cycle.

2. Vacuum pump according to claim 1, wherein said upper chamber (11) has a diameter smaller than a diameter of the lower chamber.

3. Vacuum pump according to claim 1, wherein said upper chamber (11) has a generally conically shaped top surface (24) and said upper part (14) of the piston (13) has a shape corresponding to said top surface.

4. Vacuum pump according to claim 1, further comprising a communications means (34) between the inlet (33) and the lower chamber (12) and arranged to be open when the piston reaches an upper position.

5. Vacuum pump according to claim 1, wherein said pump, via a movement transmission mechanism (31), is connected to an electric drive motor (32), the mechanical power of the pump not exceeding 1 W.

6. Vacuum pump according to claim 1, wherein said first and second check valves comprise valve bodies (23, 28) and said vacuum pump further comprises at least one means (19, 29) for lifting one of the valve bodies (23, 28) near a dead point of the piston.

7. Vacuum pump according to claim 1, wherein a gas from said space to be evacuated is compressed in said lower compression chamber and further compressed in said upper compression chamber.

8. Vacuum pump according to claim 1, wherein said lower chamber (12) has a generally conically shaped bottom surface (16) and said piston (13) has a central recess (20) with a shape corresponding to the bottom surface (16).

9. Vacuum pump according to claim 3, wherein said generally conically shaped bottom surface (16) is formed by surfaces (17, 18, 19) having different inclinations.

10. Vacuum pump according to claim 1, wherein said piston (13) is connected to at least one drive means (30).

11. Vacuum pump according to claim 10, wherein said drive means (30) is a rod which extends through liquid in the de-aeration receptacle (27).

12. Vacuum pump according to claim 1, wherein said lower part (15) of the piston (13) is provided with at least one opening (35) which connects the lower chamber (12) with the inlet (33), the opening forming a power limiting valve.

13. Vacuum pump according to claim 12, wherein said power limiting valve comprises a fine mesh net (36) covering the at least one opening.

14. Vacuum pump according to claim 13, wherein said fine mesh net has a mesh size between 10 and 50 um.

* * * * *